United States Patent [19]

Schiller

[11] Patent Number: 4,744,235

[45] Date of Patent: May 17, 1988

[54] ACTUATOR DEVICE FOR AXIALLY SHIFTING ROLLING MILL

[75] Inventor: Günter Schiller, Kreuztal, Fed. Rep. of Germany

[73] Assignee: SMS Schloemann-Siemag Aktiengesellschaft, Dusseldorf, Fed. Rep. of Germany

[21] Appl. No.: 896,859

[22] Filed: Aug. 14, 1986

[30] Foreign Application Priority Data

Aug. 16, 1985 [DE] Fed. Rep. of Germany ..... 3529364

[51] Int. Cl.[4] ..... B21B 31/18; B21B 31/10; B21B 31/32

[52] U.S. Cl. ..... 72/247; 72/238; 72/243; 72/245

[58] Field of Search ..... 72/247, 245, 243, 241, 72/237–239, 20, 21, 249

[56] References Cited

U.S. PATENT DOCUMENTS

| | | | |
|---|---|---|---|
| 4,369,646 | 1/1983 | Kajiwara | 72/243 |
| 4,491,005 | 1/1985 | Kimura et al. | 72/247 X |
| 4,581,914 | 4/1986 | Masui | 72/247 X |

FOREIGN PATENT DOCUMENTS

| | | | |
|---|---|---|---|
| 0009513 | 1/1982 | Japan | 72/247 |
| 0202911 | 12/1982 | Japan | 72/247 |
| 0110406 | 6/1984 | Japan | 72/247 |

*Primary Examiner*—Robert L. Spruill
*Assistant Examiner*—Steve Katz
*Attorney, Agent, or Firm*—Karl F. Ross; Herbert Dubno

[57] ABSTRACT

The rolls of a rolling mill can be axially moved by way of an actuator device equipped with piston-and-cylinder units. The bearing blocks which receive the journal ends of the rolls to be moved are horizontally guided in separate guide bodies. The guide bodies, in turn can be shifted vertically in cylinder blocks arranged at the flanks of the windows of the respective base member, or in pressure plates associated with such cylinder blocks. The actuator device is characterized by a compact design which even during exchange of rolls is contained in the confines of the roll stand, and it can be easily coupled to the rolls to be moved. The guide bodies of at least one base member are formed with lateral projections at which are mounted the motive power providing hydraulic cylinders, and these are connected in such a way that the piston rods thereof point in the direction of the guide bodies. The heads of the piston rods of two superimposed arranged piston and cylinder units are respectively connected by way of a vertical yoke. The vertical yoke in turn can be connected to the mounting element which is guided in the guide bodies, and it can be disconnected, particularly for the exchange of the working rolls.

4 Claims, 3 Drawing Sheets

ACTUATOR DEVICE FOR AXIALLY SHIFTING ROLLING MILL

CROSS REFERENCE TO RELATED APPLICATIONS

This application is related to the commonly assigned copending application Ser. No. 06/896,860 filed Aug. 14, 1986 by myself and others.

FIELD OF THE INVENTION

My present invention relates to an actuator device for a rolling mill and to a rolling mill stand provided with improved means for shifting certain of the rolls thereof axially. More particularly, this invention relates to an actuator device or similar mechanism which can carry out axial adjustment of positions of the rolls.

BACKGROUND OF THE INVENTION

The rolls to be moved are usually journaled with their respective trunnion or journal ends in holding elements or mounting pieces, i.e. bearing blocks, which, in turn, are arranged in guide pieces or bodies. The guide pieces are arranged at the sides of the respective windows or openings of the base or frame members, i.e. in cylinder blocks, or in pressure plates associated therewith, so as to be vertically movable.

German patent No. 24 40 495 describes a rolling mill with two working rolls, two intermediate rolls, and two support or backing rolls. Axial displacement of the intermediate rolls is carried out with hydraulic cylinders. The hydraulic cylinders can be provided in the base or frame member of the mill stand, and they are fixed, or movable in cylinder blocks of the base. This provides a compact assembly and arrangement.

However, because the hydraulic cylinders, when considering the arrangement in the base or in the cylinder block, are provided at a constant height, during shifting of the rolls one can not preclude moments which will impact in undesired manner on the bearing blocks. Accordingly, rather complex designs for the bearing blocks are required to prevent inappropriate stressing thereof, particularly moments which arise due to different positions of the holding elements or bearing blocks.

It was also found of disadvantage that the base or support members are weakened when making provision for mounting of the piston-and-cylinder units which effect the displacement, or to arrange the hydraulic piston-and-cylinder in the cylinder blocks. This, however, will mean that the provision of sufficiently powerful units for adjusting, bending or balancing, of the rolls will be made more difficult. Although one could make the cylinder blocks larger, this is generally not a desirable solution.

OBJECTS OF THE INVENTION

It is one object of the invention to provide a compact actuator device for axially moving rolls in a rolling mill stand.

It is also an object of the invention to provide an improved actuator device which is capable under various positions of the rolls, as well as various wear conditions thereof during the positioning, to preclude the transfer of undesirable moments to the holding elements.

It is further an object of the present invention to provide an improved rolling mill stand which is easily accessible and sufficiently open to facilitate inspection and maintenance.

It is still another object of my invention to provide an actuator device which can easily accommodate attendant sensors and controls so that these will not interfere with the required motions.

SUMMARY OF THE INVENTION

The foregoing and other objects and advantages of the invention are obtained in a rolling mill stand in which the respective guide bodies of one of the base members are provided with laterally extending hydraulic cylinders in a cantilever fashion. The support is such that the cylinder's cover or end plate, through which its piston rod extends, is effectively supported for likewise supporting the cylinder.

The heads of the piston rods are connected to bridges or yokes which can be connected to the holding elements or bearing blocks of the respective rolls. These holding elements, in turn, are arranged in associated guide pieces.

Due to relatively short mounting formations, the respective hydraulic actuating piston-and-cylinder units can be arranged in laterally projecting manner. By being mounted on the guide pieces, the cylinders which provide the motive power for the actuator mechanism will take part in any adjustment of height that is done by the holding elements. Accordingly, the centered operation is not hampered by various positions of the rolls to be manipulated.

At the same time the requirement is satisified that for the exchange of rolls one quickly and directly releases the bearing blocks of those rolls which are to be taken out.

Preferably, the head of each piston rod is connected to a linking element allowing limited swinging and which, in turn, is connected with the respective bridge.

In accordance with another preferred embodiment, the bridges can be connected to the respective holding elements by means of connector pins which extend through both of these elements.

It is also preferred that the bridges are formed with projections which respectively support a locking piston-and-cylinder unit and the piston rod thereof is capable of actuating the connector pin.

In accordance with another feature of the invention, the holding elements of the intermediate rolls are formed with extensions which, by means of two horns, can reach respectively over one bridge on both sides thereof.

In accordance with a further feature of the invention, the guide pieces of at least one base member are equipped with movable holding claws which can be attached as required. These holdings claws can be swung, by way of a drive or actuator means, into matching grooves of a coupling receptor arranged on the drive spindle for the respective driven roll.

DESCRIPTION OF THE DRAWING

The above and other objects, features and advantages of my invention, will become more readily apparent from the following description, reference being made to the accompanying highly diagramatic drawing in which.

SPECIFIC DESCRIPTION

Figure 1:
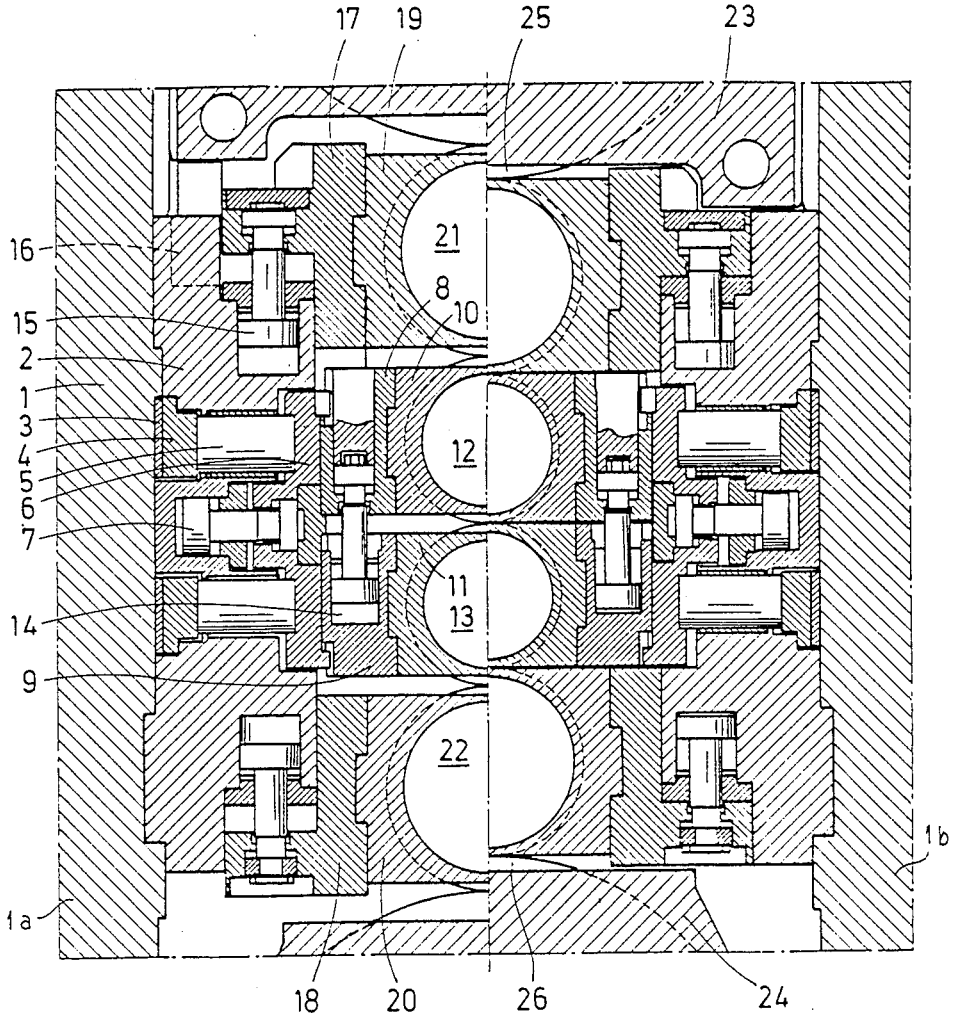
FIG. 1 is a vertical cross-section view through the central portion of a base member of a six-high rolling mill stand.

FIG. 1 shows a six-high rolling mill, and particularly a portion of the left vertical beam or similar support 1*a*, and shows a portion of the right vertical beam 1*b* of a rolling mill frame or stand 1. These beams define the lateral sides of a window in the frame 1.

Cylinder blocks 2 are mounted on the respective beam surfaces of the frame 1. The cylinder blocks 2 are formed with recesses which are linked with wear plates 3.

The wear plates 3 are provided for supporting wedge-shaped tongues or legs 4 of an actuator unit, such that the tongues 4 can horizontally slide on the surfaces of the respective wear plates 3. The actuator unit, in turn, is used for effecting the horizontal displacement of the working rolls 12 and 13. Accordingly, the cylinder blocks 2 have recesses in which are arranged cylindrical pressure posts 5 which are supported on the tongues 4 with their foot ends (left ends in FIG. 1).

The respective head ends of the pressure posts 5 are supported against a pressure plate 6. The pressure posts 5 and other elements in the rolling mill are provided symmetrically with respect to the centerline shown in FIG. 1. Accordingly, these elements are only discussed once at times, and they need not be described again since the configuration and function thereof would be analogous if not identical.

A horizontally disposed piston-and-cylinder unit, generally indicated by the reference number 7, serves to tension or clamp the pressure plate 6 against the head ends of the pressure posts 5. For actuation, this piston-and-cylinder unit 7, cylinder 7 hereinafter, is supplied with a pressure medium by way of conduits or passages, not shown in detail because they are known in the art.

An upper intermediate guide body 8 and a lower intermediate guide body 9 are arranged in vertical guides, e.g. grooves, of the pressure plate 6. The intermediate guide bodies 8 and 9, in turn, serve to guide, by way of horizontal guide elements, e.g. grooves, the mounting or bearing blocks 10 and 11 of the working rolls 12 and 13 respectively. The intermediate guide bodies 8 and 9 can be moved with respect to one another by way of a vertically arranged piston-and-cylinder unit, cylinder 14 hereinafter, also supplied with a pressure medium. For example, the cylinder chamber of cylinder 14 can be provided in the guide body 9, and the piston is then secured in the guide body 8, as is shown in FIG. 1.

Accordingly, actuation of the cylinder 14 will separate or bring together the working rolls 12 and 13 in conformity with the movements of the piston because movements of the intermediate guide bodies 8 and 9 will cause corresponding movements of the bearing blocks 10 and 11. This is schematically indicated in FIG. 1 by a gap between the bearing blocks 10 and 11 to the left side of the centerline, whereas the bearing blocks 10 and 11 are shown in contact with one another on the right side. The associated components, of course, will carry out and/or allow the respective movements.

An upper guide body 17 and a lower guide body 18 are respectively arranged with corresponding formations in vertically disposed guide elements, e.g. grooves, dovetail recesses or the like, of the cylinder block 2. The guide bodies 17 and 18, in turn, control the movement of the bearing blocks 19 and 20 for the intermediate rolls 21 and 22 by being respectively arranged with corresponding formations in horizontally disposed guides, e.g. recesses, dovetail grooves or the like formations.

Only proportions are shown, furthermore, of the upper bearing blocks 23 and lower mounting or bearing blocks 24 for the outer support rolls 25 and 26 respectively. These components are operated in analogous manner.

The guide bodies 17 and 18 can pretensioned by vertically disposed piston-and-cylinder units, cylinders 15 hereinafter, also supplied with a pressure medium. Thus, the cylinder chamber of each cylinder is typically provided in the associated cylinder blocks 2 and the piston is connected to the respective guide body 17 and 18. Again, a gap is shown to the left of the centerline between the bearing blocks 19 and 20, whereas they are shown in contacting position on the right side of the centerline. As well, the associated components will carry out and/or allow the respective movements.

Additional vertically disposed piston-and-cylinder units, cylinders 16 hereinafter, are provided in the cylinder blocks 2. Pressure medium is supplied in conventional manner to the cylinders 16. Specifically, one cylinder 16 is indicated at the top left side, for the related movement, for pretensioning and/or balancing, of the bearing blocks 23 and the associated supporting roll 25. The bearing block 24 and its associated lower supporting roll 26 are actuated in corresponding manner.

Figure 2:
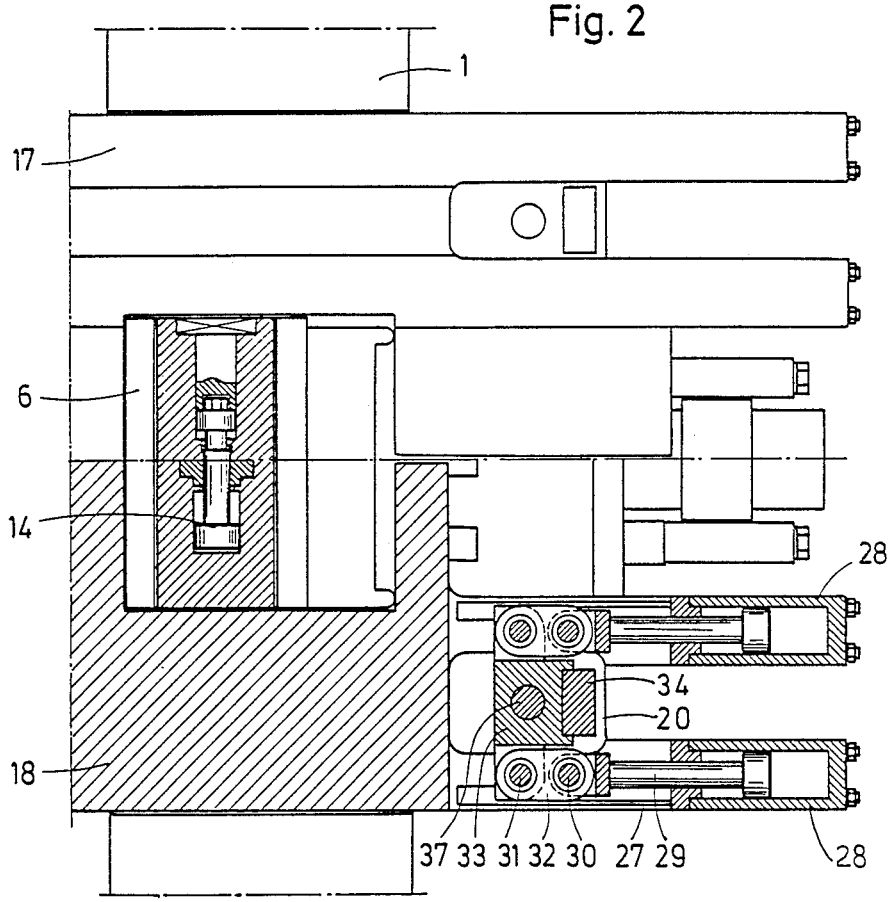
FIG. 2 is vertical cross-section view of the roll stand parallel to the window in the base member.

FIG. 2 shows an elevation of the upper guide body 17 and a section through the lower guide body 18. As can be seen in FIG. 2. the guide bodies 17 and 18 are provided with lateral mounting formations or structures 27 which can support, in cantilever fashion, adjustment piston-and-cylinder units 28, cylinders 28 hereinafter. The cylinders 28 are supplied with a pressure medium in conventional manner.

Each adjustment cylinder 28 is mounted in such a way that the cylinder's mounting plate, through which the piston rod 29 extends, is directed towards and connected at the respective guide body 17 and 18.

The head of each piston rod 29 is typically connected to a linking element 32 by means of a pin 30 and pivoting and the like swivel-type movements can be carried out by the linking element 32.

The other end of each linking element 32, in turn, is connected, by way of a second pin 31, at the lateral ears or clevis formations 33*a* and 33*b* of a yoke 33.

Thus, in the embodiment of FIG. 2, a pair of adjusting cylinders 28 is provided, and the head end of the piston rod 29 of the upper cylinder 28 is connected to the upper clevis formation 33*a*, whereas the piston rod 29 of the lower cylinder 28 is connected to the lower clevis formation 33*b* of the bridge 33.

Because they are horizontally guided by them, movement of the bearing blocks 19 and 20 is controlled by the guide pieces 17 and 18, respectively. The bearing blocks 19 and 20 are respectively formed with a projection which extends with a horn 34 over the respective yoke 33 which is connected to a pair of cylinders 28. Each horn 34 is adapted to act as a stop.

Figure 3:
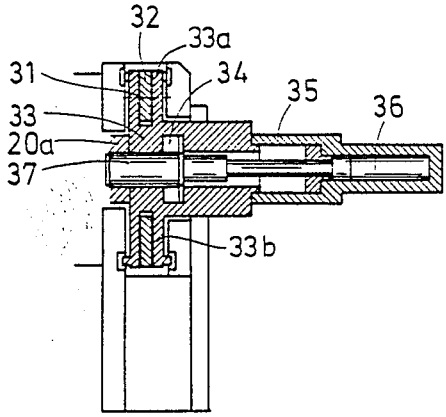
FIG. 3 is also a vertical cross-sectional view at the axis of the connecting pin in FIG. 2.

As is indicated in detail in FIG. 3 a yoke 33 can be releasably linked to a respective bearing block 19 and 20 by way of a coupling pin 37. For this the bearing block includes a projection, see particularly projection 20*a*. FIG. 3 also shows the clevis formations 33*a* and 33*b* of the yoke 33. The clevis formations 33*a* and 33*b* are connected in bifurcate manner at the respective linking element 32 by way of the respective pins 31.

The yoke 33 has a lateral port member 35 at which is mounted a piston-and-cylinder unit 36, locking cylinder 36 hereinafter. The piston rod of the locking cylinder 36 is connected to the coupling pin 37. In the shown embodiment, the coupling pin has been pushed through the yoke 33 and laterally into the projection 20*a* of the bearing blocks 20 to effect the desired connection and locking.

Figure 4:
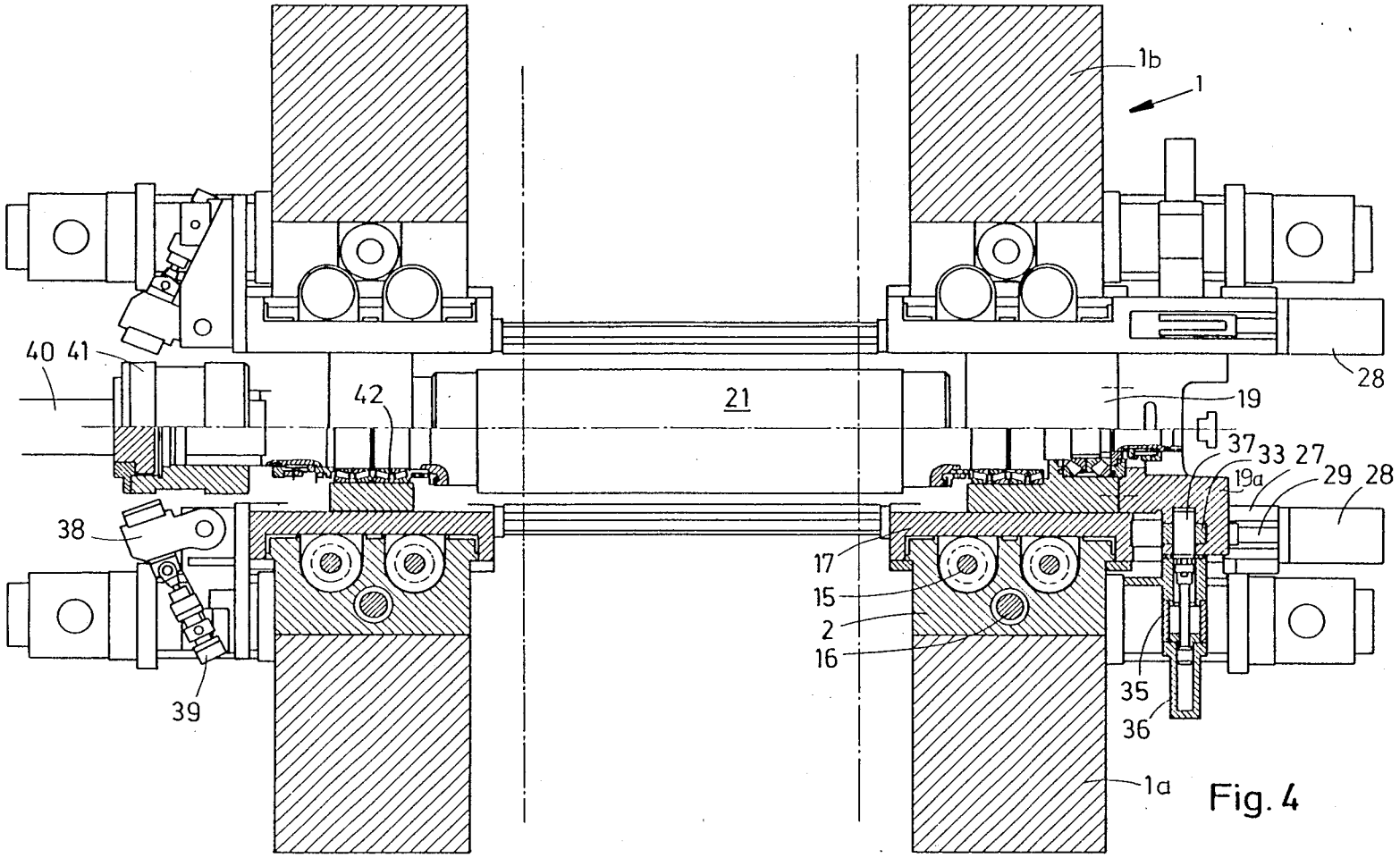
FIG. 4 is a section along the axis of one of the intermediate rolls in FIG. 1.

For further understanding of the embodiment, a horizontal section is shown in FIG. 4 through the entire frame according to FIG. 1. The cross section shown in the lower half is that taken at the level of the axis of the intermediate roll 21, whereas the cross section shown in the upper half of the drawing is that taken at the level above the intermediate roll 21.

In addition to the vertically operating cylinders 15 and 16 arranged in the cylinder block 2, FIG. 4 also shows the drive spindle 40 which is connected at the drive end of the intermediate roll 21 by way of a coupling receptor 41. The drive is not shown since it is standard in the art and not material fcr understanding the invention.

The adjustment cylinders 28 are connected to the guide bodies 17. In the case of an idler roll, or similar non-powered intermediate roll, the cylinders 28 can be arranged on the side which is otherwise reserved for the drive.

In actual use, the guide bodies 17 and 18 follow, in the frame window, for example by way of vertical guides in the cylinder blocks 2, each adjustment movement of the holding elements 19, 20 for the intermediate rolls 21, 22 respectively. Thus, the cylinders 28 are maintained at the same level as the respective bearing blocks 19, 20 and, more particularly, symmetrically to the central axis thereof.

To preclude undesired stresses, the piston rods 29 of the cylinders 28 are connected, for example as described with reference to FIG. 3 by way of the linking elements 32 and the upper and lower clevis formations 33*a* and 33*b*, or the like elements, to the yokes 33. The linking elements are guided a desired distance in the mounting formation 27.

The centers of the yokes 33 are then also always centered with respect to the mounting or bearing blocks 19. A yoke 33 is connected by way of the coupling pin 37 and generally at the level of the roll axis with the respective mounting projection of the bearing block 19.

Due to the symmetrical and centered transfer of the shifting forces, each bearing block 19 or 20 and its particular mounting projection can be light in weight and of relative small configuration, such that one can, for example, easily access a flap ring, not shown, which will allow removal of the bearing blocks.

Because a yoke 33 is equipped with the cylinder 36 which actuates the coupling pin 37, coupling and uncoupling can be readily effected. In this it also has been found advantageous to utilize the cylinders 28 for removal of the mounting end of the intermediate roll 21 from the coupling receptor 41 of the drive spindle 40.

Thus, with further reference to FIG. 4, swingable holding claws 38 are connected at the guide body 17 at the side of the drive (left hand side in FIG. 4) to the supports of the frame and/or respective cylinder block 2. The holding claws 38 can be moved or swung, by way of piston-and-cylinder units 39, cylinders 39 hereinafter, when the coupling receptor 41 is in the pre-set position, into a groove of the coupling receptor 41. Accordingly, upon engagement, they will grip and position the coupling receptor 41 and the drive spindle 40 which carries it.

When through actuation of the adjustment cylinders 28, with their piston rods 29, the linking elements 32 connected to the piston rods 29, and the yokes 33, a mounting element 19 has been extracted, the latter also extracts the intermediate roll 21 by extracting the respective opposite roll end from the coupling receptor 41. The coupling receptor 41 is then held by the holding claws 38 in its receiving position until after full introduction of a new intermediate roll.

Thus, during the initial phase of extraction, the coupling pin 37 remains inserted. Only after loosening of the end of the intermediate roll 21, on the side of the drive (left side in FIG. 4) from the coupling receptor 41 and loosening being done by means of the cylinder 36, is the coupling pin 37 extracted to such an extent that the projection 19*a* of the mounting element 19 is free and further extraction can occur.

Thus, a compact construction of the actuator mechanism for shifting the rolls is achieved. The device affords easier uncoupling for replacement or exchange of rolls. As has been explained with reference to FIG. 4, the device also provides for easier disengagement or loosening of the mounting end of the driven intermediate roll from the coupling receptor 41. Furthermore, the mechanism allows smooth and effective extraction of the respective roll.

The actuator mechanism can be modified in several ways. One simple embodiment is achieved by the use of idler or non-powered rolls, and the actuator device can then be provided on that side which is normally reserved for the drive equipment.

The device is characterized by a compact design, and it provides a corresponding savings of space.

Furthermore, it was found that the centered manipulation of the roll or axle to be shifted is highly desirable, and stressing of the bearing blocks by moments, during the positioning or setting operation, is effectively precluded. Accordingly, the design of the holding elements to adapt to these forces or moments need not be associated with considerable effort and rigidity.

Thus the respective rolls of a rolling mill can be axially moved and/or extracted by way of an actuating mechanism equipped with piston-and-cylinder units. The bearing blocks which receive the journal ends of the rolls to be moved are horizontally guided in separate guide bodies. These guide bodies, in turn, can be shifted vertically in cylinder blocks arranged at the flanks of the windows of the respective base member, or in pressure plates associated with such cylinder blocks.

The actuating mechanism is characterized by a compact design which even during exchange of rolls, is contained in the confines of the roll stand or frame. Furthermore, it can be easily coupled to the rolls to be moved. The guide bodies of at least one frame member are formed with lateral projections at which are mounted the hydraulic cylinders which effect the attendant movements. The cylinders are connected in such a way that the piston rods thereof point in the direction of the guide bodies. The heads of the piston rods of two superimposed arranged piston and cylinder units are respectively connected by way of a vertical yoke. This vertical yoke, in turn, can be connected to the mounting element which is guided in the guide bodies, and it can be disconnected, particularly for the exchange of the working rolls.

Various elements have been described individually in the foregoing. However, is will be clearly understood with reference to the drawings, particularly FIG. 1, that various elements are provided in pairs, symmetrically with respect to the centerline, and operated as pairs. Examples of such elements include the vertical cylinders 14, vertical cylinders 15, and pressure plates 6 to mention a few.

The trunnion ends of the rolls can be arranged in bearing rows, as is generally indicated for the roll 21 by bearing rows 42 in FIG. 4.

I claim:

1. A rolling mill stand, comprising:

a pair of uprights each positioned on a respective side of the stand and provided with a respective window;

a plurality of rolls disposed one above another between said uprights and having stubs at respective ends journaled in said windows, said rolls including a pair of working rolls defining a nip between them through which stock to be rolled is passed, at least one of said rolls being shiftable in a direction parallel to an axis thereof relative to others of said rolls and said uprights;

respective bearing blocks located in said windows and receiving stubs of said one of said rolls for journalling said one of said rolls on said stand;

respective guide bodies receiving each of said bearing blocks and formed with means defining a direction of displacement of said bearing blocks and said one of said rolls parallel to the axis thereof;

means in each of said windows acting upon the respective guide body for vertically shifting same and said one of said rolls relative to said uprights;

laterally projecting formations on one of said guide bodies at one end of said one of said rolls extending away from the respective upright;

a first pair of horizontally spaced hydraulic cylinder units and a second pair of horizontally spaced hydraulic cylinder units for displacing said one of said rolls, each of said units including:

a respective hydraulic cylinder fixed to a respective one of said formations, and a respective piston shiftable in each of said cylinders and extending therefrom toward said one of said guide bodies and having a free end;

a first yoke pivotally connected to the free ends of said pistons of said first pair of hydraulic cylinder units, and a second yoke pivotally connected to the free ends of said pistons of said second pair of hydraulic cylinder units;

a projection formed on the bearing block received in said one of said guide bodies and extending out of the respective one of said windows, said yokes straddling said projection;

respective pins insertable through each yoke and into said projection from opposite sides thereof to articulatedly connect each of said yokes to said projection; and hydraulically actuatable means connected to said plus for retracting same from said projection to decouple said yokes therefrom and permit withdrawal of said one of said rolls from said stand through said one of said windows.

2. The rolling mill stand defined in claim 1, further comprising a respective link pivotally connected to each of said free ends of said pistons and pivotally connected to the respective yoke.

3. The rolling mill stand defined in claim 1, further comprising a drive spindle disposed along side the other of said uprights and engageable with the stub of said one of said rolls for driving same.

4. The rolling mill stand defined in claim 3, further comprising a pair of holding members engageable with said spindle for retaining same in position to receive the stub of a roll insertable in said stand upon replacement of said one of said rolls.

* * * * *